US009206008B2

(12) United States Patent
Hein

(10) Patent No.: US 9,206,008 B2
(45) Date of Patent: Dec. 8, 2015

(54) WEB GUIDE CONTROL UNIT, WEB PROCESSING APPARATUS AND METHOD FOR OPERATING THE SAME

(71) Applicant: Applied Materials, Inc., Santa Clara, CA (US)

(72) Inventor: Stefan Hein, Blankenbach (DE)

(73) Assignee: APPLIED MATERIALS, INC., Santa Clara, CA (US)

( * ) Notice: Subject to any disclaimer, the term of this patent is extended or adjusted under 35 U.S.C. 154(b) by 215 days.

(21) Appl. No.: 13/871,828

(22) Filed: Apr. 26, 2013

(65) Prior Publication Data

US 2014/0209731 A1 Jul. 31, 2014

(30) Foreign Application Priority Data

Jan. 31, 2013 (EP) ..... 13153506

(51) Int. Cl.

| | |
|---|---|
| ***B65H 77/00*** | (2006.01) |
| ***B65H 23/04*** | (2006.01) |
| ***B65H 23/038*** | (2006.01) |
| ***B65H 23/188*** | (2006.01) |

(52) U.S. Cl.

CPC ..... *B65H 23/044* (2013.01); *B65H 23/038* (2013.01); *B65H 23/048* (2013.01); *B65H 23/1888* (2013.01); *B65H 2301/51145* (2013.01); *B65H 2404/1526* (2013.01); *B65H 2511/242* (2013.01); *B65H 2515/312* (2013.01); *B65H 2515/314* (2013.01); *B65H 2553/22* (2013.01); *B65H 2553/23* (2013.01); *B65H 2553/26* (2013.01); *B65H 2553/822* (2013.01); *B65H 2557/264* (2013.01); *B65H 2701/1732* (2013.01); *B65H 2701/1752* (2013.01)

(58) Field of Classification Search

USPC ..... 242/413.3, 418.1, 419.1, 420.6, 421.5

See application file for complete search history.

(56) References Cited

U.S. PATENT DOCUMENTS

| | | | |
|---|---|---|---|
| 2002/0083854 A1 | 7/2002 | Brennan et al. | |
| 2010/0038468 A1 | 2/2010 | Hein | |

FOREIGN PATENT DOCUMENTS

| | | | | |
|---|---|---|---|---|
| EP | 1288150 A2 * | 3/2003 | ..... | B65H 23/04 |
| EP | 1964799 A1 * | 9/2008 | ..... | B65H 23/18 |
| WO | 2006/087428 A1 | 8/2006 | | |

OTHER PUBLICATIONS

Extended European Search Report dated Jul. 19, 2013 for Application No. 13153506.4.

* cited by examiner

*Primary Examiner* — Sang Kim

(74) *Attorney, Agent, or Firm* — Patterson & Sheridan, LLP

(57) ABSTRACT

A web guide control unit for guiding a web is provided. The web guide control unit includes a web guide control unit for guiding a web. The web guide control unit includes a guide roller. The guide roller includes an adjustment unit and two tension measurement units for measuring the tension of the web at a first location and a second location of the guide roller. The present disclosure also provides a web processing apparatus with at least one web guide control unit as described herein is provided. A method for guiding a web by means of the web guide control or the web processing apparatus is also disclosed.

13 Claims, 5 Drawing Sheets

WEB GUIDE CONTROL UNIT, WEB PROCESSING APPARATUS AND METHOD FOR OPERATING THE SAME

TECHNICAL FIELD OF THE INVENTION

The present subject-matter relates to a web guide control unit and a web processing apparatus. The present subject-matter relates particularly to a web guide control unit for compensating failures in the raw material and/or the coiling installation, in particular in vacuum conditions. It particularly relates to a web processing apparatus for coating web in vacuum installations. The present subject-matter also relates to a method for guiding a web and particularly to a method for compensating failures in a web during web guiding, in particular in vacuum conditions.

BACKGROUND OF THE INVENTION

Web handling is an important issue in installations for processing continuous web. Therein, many coils handling hundreds of meters or even kilometers of web have to be arranged and operated in such a way that no damage, in particular unilateral thermal damages such as crinkles, trumlines, tear-offs, or the like occur in the web. However, the web thickness of, for instance, plastic or metal foils varies over the substrate width. Also, sometimes the web is wound up on the storage spool coil (also called "storage spool" herein) with a different inner tension over the web's width.

It is undesirable that failures occur during the web processing such as the web coating. These failures may lead to the total stop of production and/or to the rejection of parts or the entire web treated. In other words, a web guiding malfunction can be very expensive and time consuming.

In order to avoid malfunctions of a web processing apparatus it is known in the art to provide each guide roll of the web guiding apparatus with a specific tolerance. This way a difference up to, e.g. 0.02 mm in the web's thickness along the width of the web can be handled. However, in installations with long coiling length the addition of the guide roller bearing tolerances can cause a tilted feeding in the installation and may lead to a diagonal pull in the winding system. Further, in vacuum applications very small deviations in thickness can cause complications or failure which would not occur at ambient pressure.

Furthermore, there are considerable space constraints in today's web processing apparatuses, such as a coating apparatus. In addition, in many applications the web must not be touched or guided on one side of the web at all, namely, the coated side of the web or foil. Consequently, the design of the web's route through a web processing apparatus, such as a coating apparatus, is essentially limited. This is particularly true if, for instance, the coating step is performed by a coating drum resulting already in a 150° up to 180° consumption of the maximally 360° overall turnings that are available for the web's route.

SUMMARY OF THE INVENTION

The problems in the state of the art are at least partly overcome by the web guide control unit, the web processing apparatus, and the method for guiding a web according to the independent claims.

In view of the above, a web guide control unit for guiding a web is provided. The web guide control unit includes a web guide control unit for guiding a web. The web guide control unit includes a guide roller. The guide roller includes an adjustment unit and two tension measurement units for measuring the tension of the web at a first location and a second location of the guide roller.

According to another aspect of the present disclosure, a web processing apparatus with at least one web guide control unit as described herein is provided. "Processing" as used herein is typically understood as "coating".

According to another aspect of the present subject-matter, a method for guiding a web by means of a web guide control unit or a web processing apparatus as disclosed herein is provided. The method includes measuring the tension of the web acting on the first location and the second location of the guide roller, thereby receiving tension data. The method further includes adjusting the position of the guide roller by moving one end of the guide roller wherein adjusting is based on the measured tension data.

The subject-matter is also directed to an apparatus for carrying out the disclosed methods and including apparatus parts for performing each described method steps. These method steps may be performed by way of hardware components, a computer programmed by appropriate software, by any combination of the two or in any other manner. Furthermore, the subject-matter is also directed to methods by which the described apparatus operates. It includes method steps for carrying out every function of the apparatus.

Further aspects, features, details and advantages are apparent by the dependent claims, the description and the accompanying drawings.

BRIEF DESCRIPTION OF THE DRAWINGS

The above features and advantages of the present subject-matter will become more apparent from the following detailed description of typical embodiments thereof with reference to the attached drawings in which.

DETAILED DESCRIPTION OF THE EMBODIMENTS

Reference will now be made in detail to the various embodiments of the subject-matter, one or more examples of which are illustrated in the figures. Each example is provided by way of explanation of the subject-matter, and is not meant as a limitation of the subject-matter. For example, features illustrated or described as part of one embodiment can be used on or in conjunction with other embodiments to yield yet a further embodiment. It is intended that the present subject-matter includes such modifications and variations.

Figure 1:
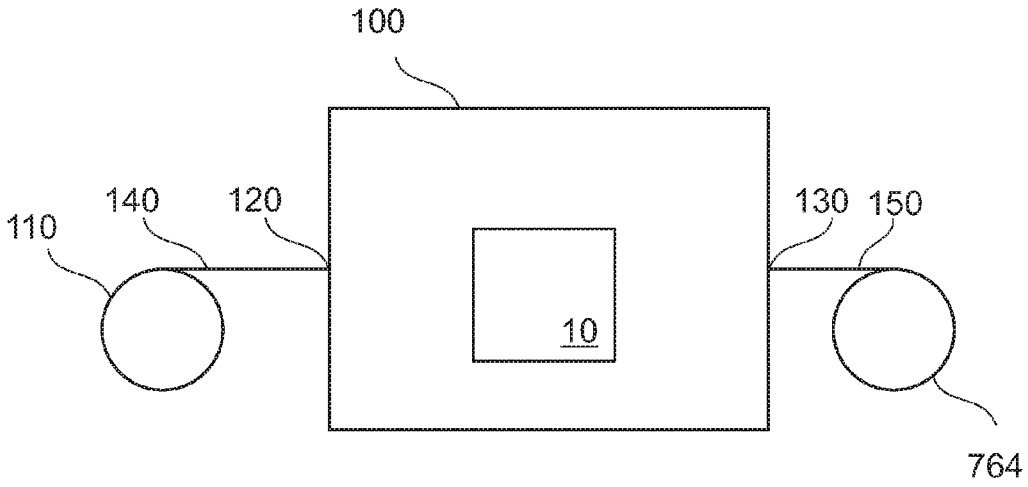
FIG. 1 shows a schematic cross-sectional view of embodiments of a web processing apparatus according to the present subject-matter.

FIG. 1 shows an embodiment of a web processing apparatus 100 where a web guide control unit 10 according to the present subject-matter is included. The web processing apparatus 100 may further include a coating unit (not shown) where a web 140 is fed to for being coated with one or more layers. Further, a storage spool 110 is shown where the web 140 is coiled. Typically, the web 140 on the storage spool 110 is unprocessed. Alternatively to the shown embodiment, the storage spool 110 may be positioned within the web processing apparatus 100 (see, for instance, the embodiments illustrated in FIGS. 5 and 6). According to typical embodiments described herein, the web processing apparatus 100 is operated at vacuum conditions, i.e., at pressures below 10 mbar or even below 1 mbar.

In the illustration of FIG. 1, the web 140 enters the web processing unit 100 via the inlet port 120, such as a first seal. The processed web 150 is guided out of the web processing unit 100 through the outlet port 130, such as a second seal, and may be spooled up on wind-up spool 764. Alternatively to the shown embodiment, the wind-up spool for storing the processed web may be provided within the web processing apparatus 100 (see, for instance, the embodiments illustrated in FIGS. 5 and 6). Consequently, in embodiments, the wind-up spool may be configured to operate in vacuum condition.

Typically, the web processing unit includes one, two, three, or more web guide control units according to the present subject-matter.

Synonyms of the term "web" are strip, foil, flexible substrate or the like. Typically, a web consists of a continuous sheet of thin and flexible material. Typical web materials are metals, plastics, paper, or the like. A web as understood herein is typically a three dimensional solid body. The thickness of the web as understood herein is typically less than 1 mm, more typically less than 500 m or even less than 10 m. A web as understood herein has typically a width of at least 0.5 m, more typically at least 1 m or even at least 4 m. A web as understood herein has typically a length of at least 1 km, 25 km or even 60 km.

A typical application of a web guide control unit or a web processing apparatus as disclosed herein is the high vacuum web film deposition. For instance, in these applications, a protective layer is deposited on a packaging substrate like thin plastic, paper, or metal foil. Thin metal or oxide films may be deposited on the packaging substrate for creating a moisture or oxygen barrier promoting freshness and extending the shelf life of the consumer products which use these films. A further application of a web guide control unit or a web processing apparatus as disclosed herein is the field of manufacturing electronic products. A conductive layer may be deposited on the web serving as conductive coating in applications such as capacitor and touch panels.

According to an embodiment of the present subject-matter, the web 140 is fed to the web processing unit 100 from a web supply such as the web storage spool 110. Typical lengths of the web on the coil are in the range between 500 m and 60 km. In embodiments, the web is fed to the web processing apparatus from a previous web processing apparatus (not shown). Generally, and not limited to the present embodiment, two, three, or more of the web processing apparatuses as disclosed herein may be positioned next to each other so that a web is consecutively lead through all of these web processing apparatuses.

Not limited to any embodiment, typical guiding velocities are in the range of between 0.01 meter per minute and 20 meter per second (m/s). Different processing steps may be performed in the web processing unit 100, such as cleaning, coating, in particular sputtering, cooling, heating, or structuring the web.

After the web has been processed in the web processing unit 100, the processed web 150 exits the web processing unit 100 at the outlet port 130. The processed web 150 may be fed to a second processing unit or guided out for storage, such as shown in FIG. 1 by the wind-up spool 764. Notably, the web processing unit, web processing apparatus and method as disclosed herein particularly allow for winding-up the web on a spool in a straight manner, thus avoiding an asymmetric layer stack on the wind-up spool.

A web guide control unit and a web processing apparatus as described herein may be used for guiding a web in various applications. The web processing apparatus as described herein is particularly suitable for coating webs such as a metal web, in particular aluminum web, and thin plastic web. Thin web in this context is meant to be understood as having a thickness of between 1 m and 200 m, in particular between 30 μm and 140 μm.

Figure 2:
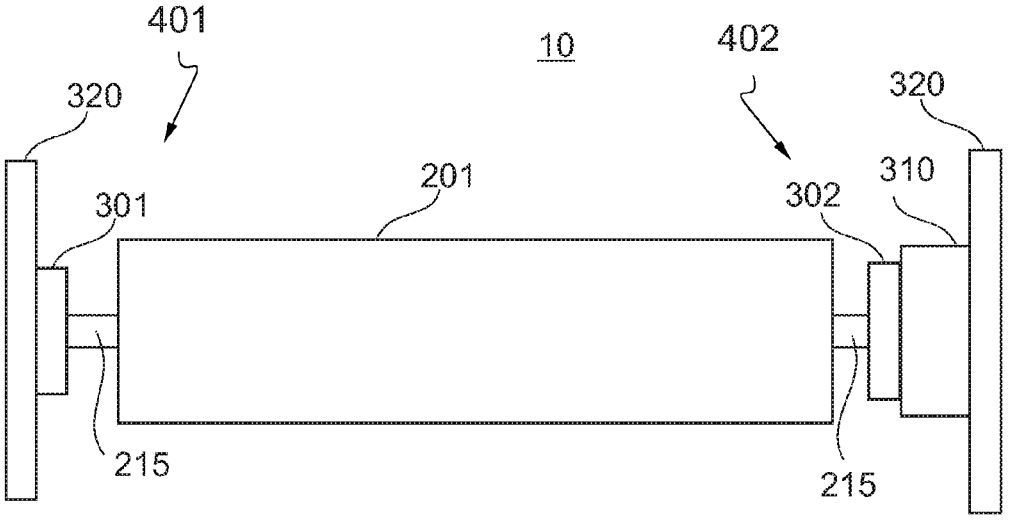
FIG. 2 shows a schematic cross-sectional view of the web guide control unit according to embodiments of the present subject-matter.

FIG. 2 shows a cross-sectional view of an embodiment of the web guide control unit 10 of the present subject-matter. The web guide control unit 10 includes a guide roller 201. The guide roller 201 is typically mounted to a shaft 215. As used herein, the term shaft shall include any support of the guide roller 201 that may be either rotatable (i.e., shaft in the strict sense), or may constitute a static axis about which the guide roller rotates.

The web 140 is guided by the guide roller 201. The web may generally be unprocessed or have already undergone one or more processing steps. In particular, the web guide control unit of the present subject-matter is not exclusively limited to the implementation in web processing apparatuses. For example, the web guide control unit can also be implemented in manufacturing plants where web transport is required.

According to aspects of the present disclosure, the guide roller is equipped with two web tension measurement units (i.e., a first web tension measurement unit 301 and a second web tension measurement unit 302) such as tension sensors (not shown). A tension sensor may be a piezoresistive or piezoelectric tension sensor. Alternatively, the sensor may be equipped with a hall element or a capacitor in order to determine the tension. According to some embodiments, the web tension control unit is provided with even more than two web tension measurement units and thus, optionally, also with more than two sensors.

According to typical embodiments, the first web tension measurement unit is provided at a first location and the second web tension measurement unit is provided at a second location. In embodiments, the first web tension measurement unit is provided at a first end of the guide roller, whereas the second web tension measurement unit may be provided at a second end of the guide roller, such as at the opposite end of the guide roller. The term "end" of the roller is to be understood in the axial direction, i.e., as the position at or close to the end of the guide roller or its shaft. For the purpose of clarity, the first end is explicitly denoted by reference number 401 in FIGS. 2 to 4, and the second end is explicitly denoted by reference number 402 in FIGS. 2 to 4.

Such an embodiment is schematically illustrated in FIG. 2 wherein at a first end of the guide roller 201 a first web tension measurement unit 301 is positioned, and a second web tension measurement unit 302 is positioned at a second end of the guide roller 201, namely, at the opposite end (in the axial direction) of the first side.

For the purpose of illustration, the guide roller 201 is shown as being mounted on a frame 320. The frame 320 may be any unit capable of supporting the web guide control unit 10. In particular, the web guide control unit may be provided with one or more bearings (not shown). Typically, the bearings are positioned between the web guide control unit 10 and the frame 320 in order to decouple a rotational movement of the shaft 215 from the frame. Notably, it is possible, but not necessary, that the frame 320 on both sides of the guide roller belongs to a one-piece frame.

The web tension measurement units 301, 302 may be positioned co-axially on the shaft 215 of the guide roller 201. The web tension measurement unit(s) may alternatively be positioned and embedded in the guide roller 201.

The web tension measurement units as described herein are typically configured to measure the tension acting on the guide roller. The tension is caused by the guided web. By measuring the tension on both sides of the guide roller and thus on both sides of the web, a difference in the tension can be measured. Based on the measured data, an appropriate adjustment can be undertaken.

Typical diameters of guide rollers used in the present subject-matter are between 65 mm and 300 mm. Typically, the web tension measurement units are adapted for measuring tensions of between 0 and 1000 N/m.

The alignment of the guide roller is adjusted using an adjustment unit 310. The adjustment unit is typically placed at the first or the second location of the guide roller. For example, the adjustment unit may be placed at the first end 401 or the second end 402 of the guide roller 201. For instance, as exemplarily illustrated in FIG. 2, the adjustment unit 310 may be placed adjacent to the web tension measurement unit. It is also possible that two adjustment units (not shown) are provided, typically each at the first and the second location of the guide roller, such as each on one end of the guide roller.

In principle, the adjustment unit may be applied for alignment of the guide roller required to avoid transversal tension acting on the web. Typically, the web guide control unit 10 of the present subject-matter is particularly useful for compensating different coiling strengths at the guide roller 201, and consequently at all equipment subsequent to the guide roller 201. Different coiling strength is most typically a result of different thickness of the web along its width. This can generally result in tilted feeding and, subsequently, varying contact between guiding rollers and web which can go along with thermal complications.

In some embodiments of the present subject-matter, the guide roller 201 is a cooling or heater roller. Typically, there are further rollers positioned downstream and/or upstream of the guide roller 201, which is exemplarily illustrated in the embodiments of FIGS. 5 and 6. Other processing steps, such as cleaning or coating, may be undertaken before (i.e., upstream) the guide roller 201 or after (i.e., downstream) the guide roller 201.

Not limited to any embodiment of the present disclosure, the tension data measured by the tension measurement units is used for adjusting the alignment of the guide roller by moving one end of the guide roller. Thereby, the alignment of the guide roller as compared to one or more of the horizontal and vertical direction is changed. If only one adjustment unit is provided at one end of the guide roller, the other end of the guide roller remains at a constant position.

The guide roller is typically moved in a dimension that corresponds to the dimension in which the force caused by the web tension acts on the shaft of the guide roller. Herein, the feature "movement in a dimension" or "measurement in a dimension", respectively, shall refer to a movement or measurement, respectively, in a direction and/or its opposite direction. For instance, the double-headed arrow in FIG. 4, referred to by number 350 illustrates one dimension. In many embodiments described herein, the tension is measured in the same dimension as the guide roller is moved.

A controller may be provided for controlling the web guide control unit. In particular, a controller may be provided for undertaking one or more of the following tasks. Receiving the measured tension data, evaluating the measured tension data, undertaking a calculation as to how the guide roller should be aligned, storing and retrieving data in and from a memory, controlling the adjustment unit, such as by controlling a motor for moving one end of the guide roller.

Figure 3:
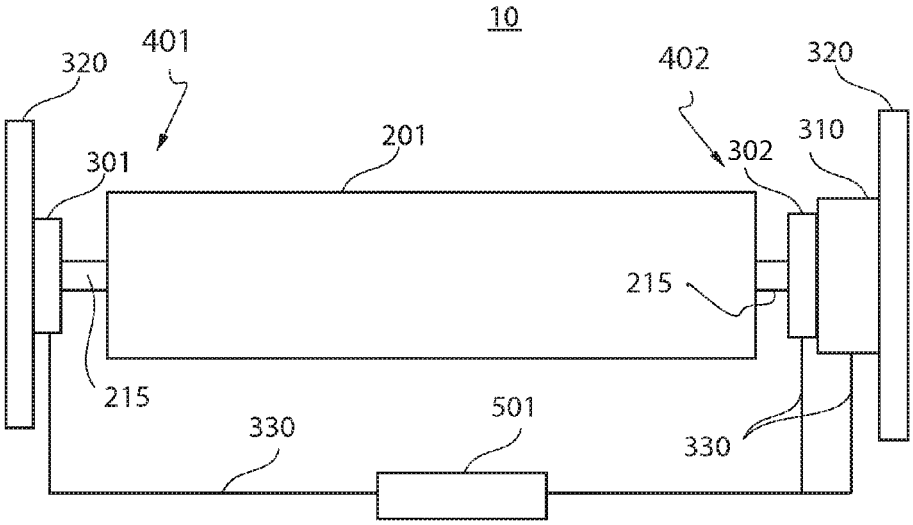
FIG. 3 shows a schematic cross-sectional view of the web guide control unit according to embodiments of the present subject-matter.

FIG. 3 shall illustrate such an embodiment explicitly illustrating a controller 501. Notably, a controller as described in respect to FIG. 3 may be provided also in all other embodiments described herein. The tension data on one end of the guide roller 201 as measured by the first tension measurement unit 301 and the tension data on the opposite end of the guide roller 201 as measured by the second tension measurement unit 302 is supplied to the controller 501 via a data connection, such as a direct data line ("peer-to-peer") or a data bus. The data may also be supplied via wireless technology.

According to embodiments that can be combined with all other embodiments described herein, the controller 501 may be a separate device (as illustrated in FIG. 3), such as including a CPU and possibly a data memory, in particular a personal computer. Alternatively, it may be integrated in one or both of the tension measurement units 301, 302, or it may be integrated in the adjustment unit 310. It may also be implemented in the main control of the web processing apparatus, such as, by a respective program or software running in the main control. In other words, existing equipment of an existing web processing apparatus may be used to implement the control of the web guide control unit of the present subject-matter.

As addressed already, the data connection 330 may be used to transmit information from the tension measurement unit 301 and/or the adjustment unit 310 to an external interface. Typically, this interface includes a personal computer which processes the data from the measurement units and/or the one or more adjustment unit. Also the interface can include an analogue front panel including different elements to tune the adjustment unit 310, i.e. using different potentiometers, dials, switches, and displays. Further, the interface can also include a digital device including numeric pads, graphical display, text commands, or a graphical user interface. Typically, all these interfaces include different features such as controller function, calibration of the system, compensation of ambient conditions, or acquisition and recording of waveforms from the tension measurement units 301, 302 or the adjustment unit 310.

The data connections 330 are typically used to transmit the information from the measurement units 301, 302, for instance via the controller 501, to the adjustment unit 310. The adjustment unit 310 receives information as to how the guide roller should be adjusted. In the simplest implementation (example 1), the information is limited to a signal as to whether an adjustment shall take place at all, and if, in which direction. The adjustment unit moves the respective end of the guide roller into this direction until the signal changes to a "no-movement" signal or a signal indicating the adjustment unit to move the guide roller in the opposite direction again. However, in one implementation, the adjustment unit is more sophisticated. For instance (example 2), it may receive information about the tension difference between the two sides of the guide roller, and the adjustment unit initiates a respective movement of the guide roller until the tension is equalized.

As mentioned before, it is generally also possible that the web guide control unit includes two adjustment units with one being positioned at the first location of the guide roller and the other one being positioned at the second location of the guide roller. Typically, each one of the adjustment units may be positioned on either end of the guide roller. In this case, both adjustment units are configured to receive tension data (as, for instance, in previous example 2) or adjustment information (as, for instance, in previous example 1).

For connecting the data connection 330, different port types are used. Typically, when serial communication is used, the ports are RS232, RS422, RS485, or universal serial bus (USB) ports. Typically, parallel communication devices are used when communication between the data connection 330 and a computer is required. Most often used parallel communication devices are DB-25, Centronics 36, SPP, EPP or ECP parallel ports. The data connection 330 can be used to make the adjustment unit 310 compatible with transistor-transistor logic (TTL) or with programmable logic controllers (PLC). Additionally the data connection 330 can be used to connect one or more of the tension measurement units 301, 302 and/or the adjustment unit 310 with a network.

According to embodiments of the present subject-matter the tension acting on both sides of the shaft 215 is acquired separately. The acquired data will be processed and sent to the adjustment unit 310 in the guide roller 201. The adjustment unit 310 adjusts the position of the shaft axis at one end of the guide roller 201. Thereby, the orientation of the shaft 215 of the guide roller is adjusted. The adjustment unit 310 is operated in order to equalize the tension measured at both sides of the guide roller 201.

Figure 4:
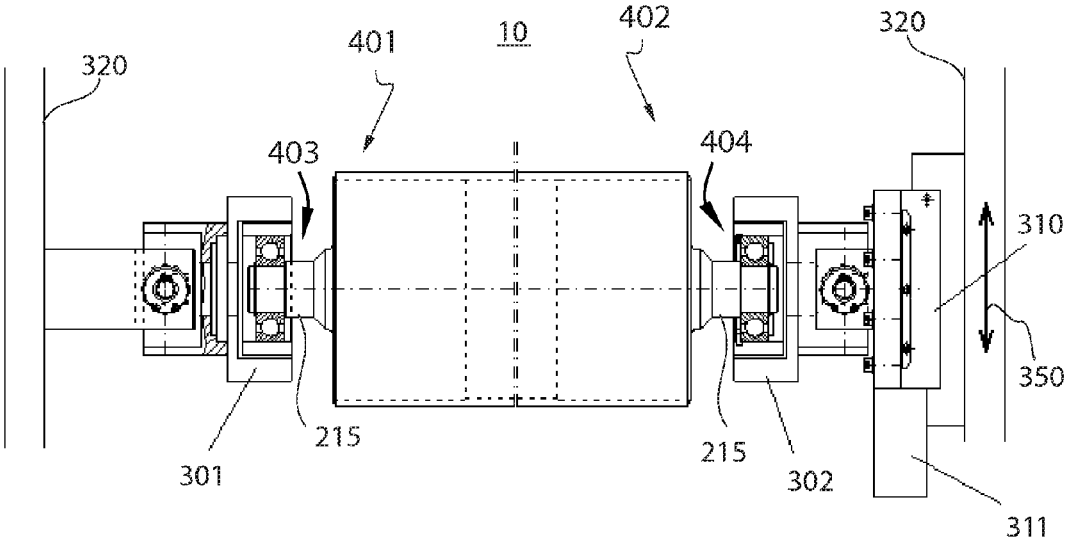
FIG. 4 shows a schematic cross-sectional view of the web guide control unit according to embodiments of the present subject-matter.

FIG. 4 shows a schematic cross-sectional view of another embodiment of the web guide control unit 10 of the present subject-matter. Throughout the whole disclosure herein, the same reference numbers are used for the same objects. The adjustment unit 310 is illustrated as including an actuator 311, such as a motor, for moving one end of the guide roller. Notably, this is not limited to the embodiment of FIG. 4, and the one or more adjustment units of all embodiments described herein may be provided with an actuator, such as a motor. For instance, the motor may be a linear motor. As indicated by the arrow 350, the motor is capable of moving the end of the guide roller up and down in the shown perspective of this page.

According to typical embodiments not limited to the embodiment of FIG. 4, the movement directions of the adjustment unit correspond to the measurement directions of the tension measurement units. That is, as in the illustration of FIG. 4, the measurement units 301, 302, such as a first tension sensor 403 and a second tension sensor 404, are typically configured to measure the tension at the guide roller in the same direction as the adjustment unit is configured to move the guide roller. For instance, in the embodiment of FIG. 4, the direction indicated by the arrow 350 may correspond both to the movement directions of the adjustment unit 310, and the measurement directions of the tension measurement units 301, 302.

Different kind of motors can be used in the adjustment unit of the present subject-matter. Typically, the actuator for adjustment is either an electrical or a hydraulic motor. Rails (not shown) or the like may be provided at the frame 320 along which the adjustment unit moves the respective side(s) of the guide roller.

In typical embodiments of the present subject-matter, the web tension measurement units include a transducer and/or a strain gauge. Typically the transducer includes a beam which stretches or compresses in response to varying tensions. The strain gauge measures the corresponding change in electrical resistance. Typically, the measurement performed by the strain gauge is amplified and converted to a voltage or current for further processing.

In general, the web tension measurement units enclose an analogue or digital front end, for further processing of the tension measurement. Typically, the web tension measurement units are mounted in the guide rollers using different options, i.e., between pillow blocks, by help of cantilevered brackets, using securing units, such as a flange or a clamp, using studs, or they may be threaded into through-holes of the guide rollers.

Figure 5:
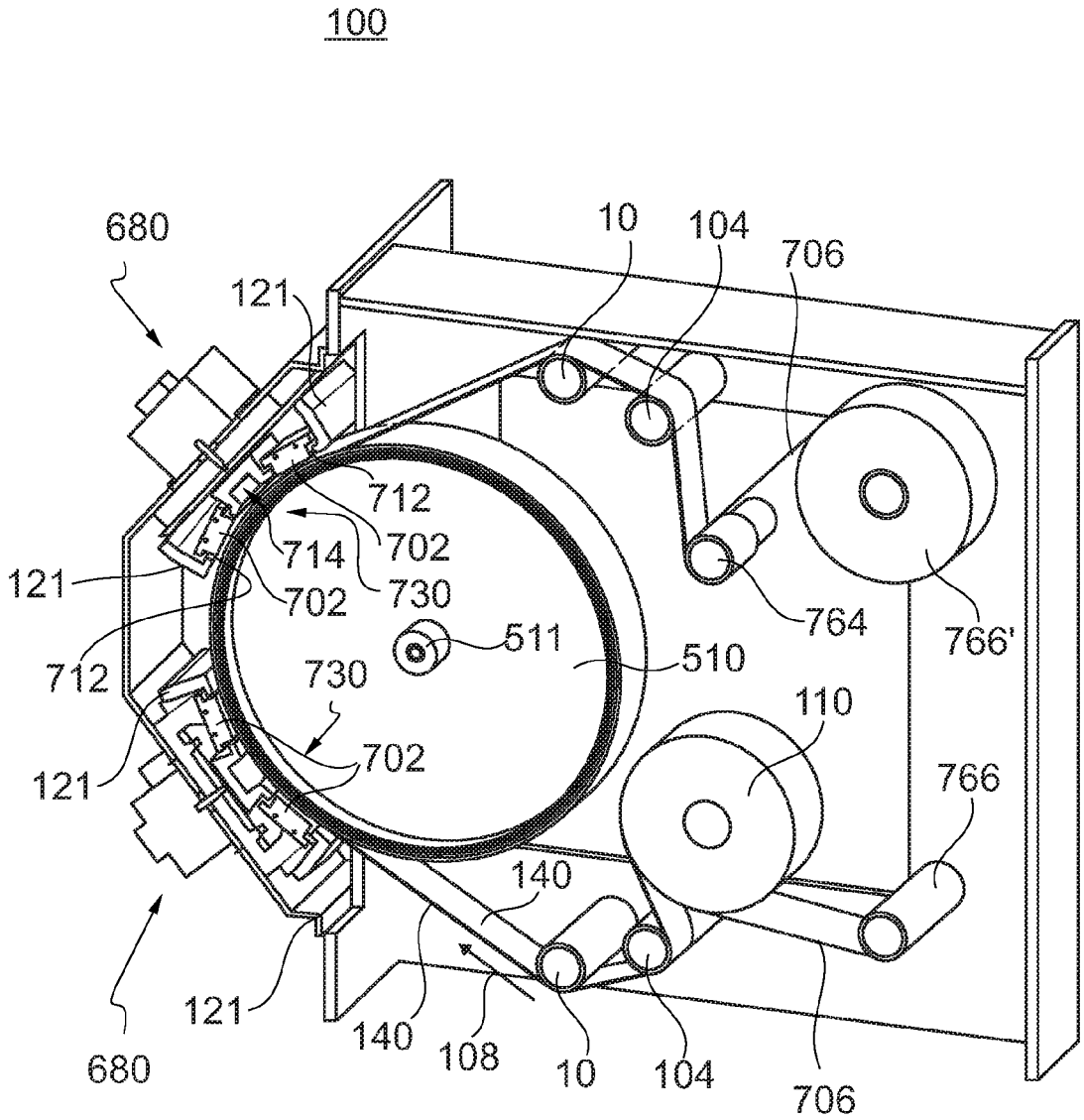
FIG. 5 shows a schematic cross-sectional view of a web processing apparatus according to embodiments of the present subject-matter.

FIG. 5 shows an example of a web processing apparatus 100, such as a coating apparatus. The terms "coating" and "deposition" are used synonymously herein. Not limited to this embodiment, the web processing apparatus may generally be configured to house the web storage spool, as it is illustrated in the embodiment of FIG. 5 and denoted by reference number 110. According to some embodiments, which can be combined with other embodiments described herein, the web to be processed can be provided on the storage spool 110 together with an interleaf 706. Thereby, the interleaf can be provided between adjacent layers of the web such that direct contact of one layer of the web with an adjacent layer of the flexible substrate on the storage spool 110 can be omitted. The web 140 is unwound from the storage spool 110 as indicated by the substrate movement direction shown by arrow 108. Upon unwinding of the web 140 from the storage spool 110, the interleaf 706 is wound on the interleaf roll 766.

The web 140 is guided via rollers 104 and, on each side of the coating unit 510, via one web guide control unit 10 as described herein. The coating unit may generally and not limited to the embodiment of FIG. 5 be a coating drum. According to embodiments, two or more rollers 104, and/or one, two, or more web guide control units 10 according to the present-subject matter may be provided in the web processing apparatus 100, for instance, at east side of the coating unit 510. Notably, a set-up of a web processing apparatus 100 wherein at least one web guide control unit as described herein is positioned on each side (i.e., downstream and upstream) of a coating unit is provided, is a typical embodiment of the present subject-matter.

After uncoiling from the web storage spool 110 and running over the roller 104 and the web guide control unit 10, the web 140 is then moved through the deposition areas provided at the coating drum 510 and corresponding to positions of the deposition sources 680. During operation, the coating drum 510 rotates around axis 511 such that the web moves in direction of arrow 108.

After processing, the web may run over one or more further web guide control units 10 (in the embodiment of FIG. 5, it runs over one web guide control unit). In addition, it may run over further rolls, such as rollers 104 depicted in FIG. 5. As the web coating in the embodiment of FIG. 5 is accomplished at that position, the web is wound up on a spool 764. A further interleaf may be provided from roll 766' between the layers of the web 140 so as to avoid damages on the web.

The web 140 may be coated with one or more thin films, i.e. one or more layers are deposited on the web 140 by deposition sources 680. The deposition takes place while the substrate is guided on the coating drum 510. The deposition sources 680, illustrated in FIG. 5, and which can be provided in embodiments described herein, include two electrodes 702, which are electrically connected to a power source (not shown).

The deposition source 680 according to some embodiments described herein, can include two gas inlets 712 at the opposing sides of the deposition source and a gas outlet 714 between the two electrodes 702. Accordingly, a gas flow of processing gas can be provided from the outer portions of that deposition source 680 to the inner portion of that deposition source. It is noted that the term "gas inlet" denotes a gas supply into a deposition region (a plasma volume or processing region), whereas the term "gas outlet" denotes a gas discharge or evacuation of deposition gas out of a deposition region. The gas inlet 712 and the gas outlet 714, according to a typical embodiment, are arranged essentially perpendicular to the web transport direction.

As illustrated in FIG. 5 and according to some embodiments described herein, the web transport direction 108 is parallel to a gas flow direction. According to different embodiments, which can be combined with other embodiments described herein, the gas inlets or gas outlets may be provided as gas lances, gas channels, gas ducts, gas passages, gas tubes, conduits, etc. Furthermore, a gas outlet may be configured as a part of a pump which extracts gas from the plasma volume.

Gas separation units 121 are provided on at least one, typically both sides of the deposition source. Thereby, the slit width of the gas separation units can be adjusted according to any of the embodiments described herein. Additionally, also the distance of the electrode 702 with respect to the substrate can be adjusted. Thereby, the support of the gas separation unit and, optionally the deposition source having the electrode therein, can be provided for adjustment of the distance to the substrate.

Embodiments described herein refer inter alia to a plasma deposition system for depositing, from a plasma phase, thin films onto a moving substrate. The web may move in a substrate transport direction in a vacuum chamber where a plasma deposition source for transferring a deposition gas into a plasma phase and for depositing, from the plasma phase, a thin film onto the moving substrate is located.

As shown in FIG. 5, and in accordance with embodiments described herein, a plasma deposition source 680 can be provided as a PECVD (plasma-enhanced chemical vapor deposition) source having a multi-region electrode device including two, three or even more RF (radio frequency) electrodes 702 arranged opposite to a moving web. According to embodiments, multi region plasma deposition sources can also be provided for MF (middle frequency) deposition.

In the embodiment shown, by running over the coating drum 510, the web passes two or more processing regions 730 that are arranged facing the deposition sources 680, such as sputter source or evaporation source, as illustrated in FIG. 5.

According to embodiments, the web processing apparatus may include more than one coating unit, such as more than one coating drum 511. It is possible to provide a web guide control unit as described herein between each two of the two or more coating drums. Additionally or alternatively, each coating unit, such as a coating drum, may be provided with one, two, three, or even more deposition sources.

FIG. 5 shows, as an example, three gas separation units 121. The gas separation units 121 may generally form two processing regions 730 (as in the example of FIG. 5) or more processing regions and possibly further regions in the web processing apparatus 100. According to typical embodiments, which can be combined with other embodiments described herein, each of the processing regions and the further areas can be evacuated independent from each other. Each processing region and/or each further area can be evacuated independently and according to the desired processing conditions, for instance, by one or more vacuum pumps (not shown).

Figure 6:
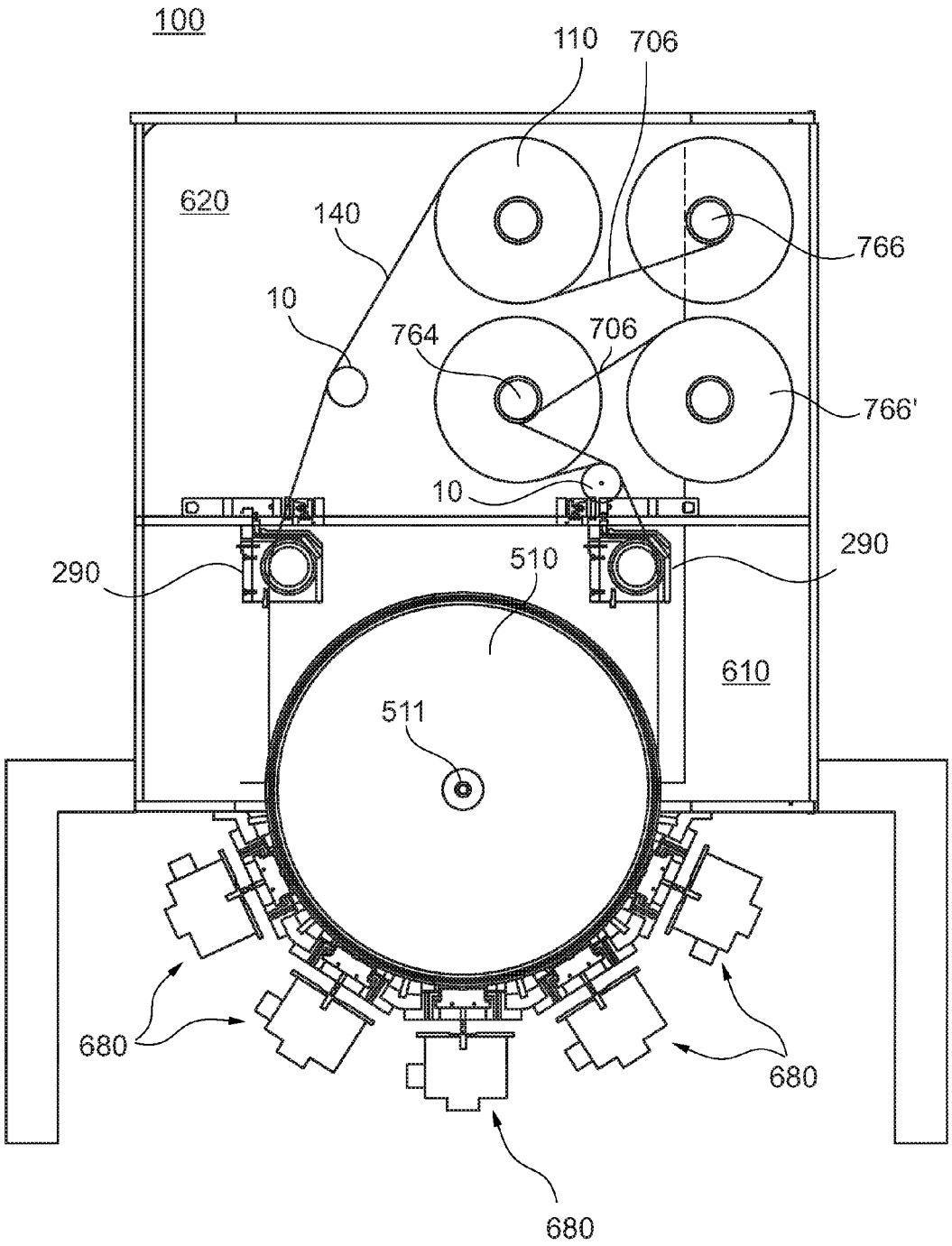
FIG. 6 shows a schematic cross-sectional view of the web processing apparatus according to embodiments of the present subject-matter.

FIG. 6 shows a further web processing apparatus 100, such as a deposition apparatus. The flexible substrate 140 is provided by the storage spool 110 positioned within the web processing apparatus. As before, the flexible substrate to be processed can be provided on the storage together with an interleaf 706. Thereby, the interleaf can be provided between adjacent layers of the flexible substrate such that direct contact of one layer of the flexible substrate with an adjacent layer of the flexible substrate on wind-up spool 764 can be omitted. Upon unwinding of the web 140 from the storage spool 110, the interleaf 706 is wound on the interleaf roll 766.

The web 140 is then moved through the deposition areas provided at the coating drum 510 and corresponding to positions of the deposition sources 680. Further details of the web processing apparatus 1000 may be identical or similar to the embodiment illustrated with respect to FIG. 5.

During operation, the coating drum 510 rotates around axis 511. According to typical embodiments not illustrated in FIG. 6, the web may be guided via one, two or more rollers from the storage spool 110 to the coating drum 510, and/or from the coating drum 510 to the second wind-up spool 764, around which the substrate is wound after processing thereof. After processing, a further interleaf can be provided from roll 766' between the layers of the web 140, which is wound on to the wind-up spool 764.

The web 140 may be coated with one or more thin films, i.e. one or more layers are deposited on the web by deposition sources 680. The deposition takes place while the web is guided on the coating drum 510.

The embodiment illustrated in FIG. 6 includes one or more web guide control units according to the present subject-matter. For instance, according to general embodiments combinable with all other embodiments described herein, as illustrated in the embodiment of FIG. 6, the web guide control unit according to the present subject-matter may be positioned between the storage spool and the coating unit, such as a coating drum. In other words, the web guide control unit may be positioned downstream of the storage spool and upstream of the coating unit, such as the coating drum.

Additionally or alternatively, it is possible that the web guide control unit according to the present subject-matter is positioned between the coating unit, such as the coating drum, and the wind-up spool (referenced to by 764 in FIG. 6). In other words, the web guide control unit may be positioned downstream of the coating unit, such as the coating drum, and upstream of the wind-up spool. Not limited to the embodiment of FIG. 6, the web guide control unit may be provided with a housing or a frame (see FIG. 3; not shown in FIG. 6).

Typically, the web guide control unit as possibly provided on each side of the coating drum is configured for measuring and adjusting the tension of the web. Thereby, the web transport can be better controlled, the pressure of the substrate on the coating drum can be controlled and/or damage to the substrate can be reduced or avoided.

As illustrated in the exemplary embodiment schematically shown in FIG. 6, the web processing apparatus may further be equipped with a seal, such as seal 290 in FIG. 6. The seal may be a static seal. The seal typically allows a pressure separation between the coating chamber 610, which includes the coating drum 510, and the web handling chamber 620, in which web guiding, web winding and/or web unwinding may be performed. Such a set-up reduces the efforts during replacing an empty web storage spool 110 with a new web storage spool, in particular, it allows keeping the coating chamber 610 at underpressure conditions or vacuum conditions while having ambient pressure in the web handling chamber. Notably, the seal may generally also be a dynamic seal, i.e., a seal that can be operated during movement of the web.

According to embodiments combinable with all other embodiments herein, the guide rollers of the web guide control unit(s) 10, and/or additional rollers, such as rollers 104 in FIG. 5, used to guide and/or to partially deviate the web, can have minimum enlacement of 13°, typically of 15° or above. Thereby, minimum enlacement relates to the fact that the enlacement varies depending on the operation conditions, for instance, in the embodiment of FIG. 6, it may vary depending on the two operation conditions when the rolls 764 and 764', respectively, are empty or filled entirely with a substrate. In addition or alternatively, in view of space constraints, the maximum enlacement is typically 30°, 25°, or even only 20°.

According to yet further embodiments, which can be combined with other embodiments described herein, additional web guide control unit(s) may be provided, located on the winding side of the coating drum, the unwinding side of the coating drum, or on both sides. For instance, the additional web guide control unit(s) may be used for the interleaf guiding.

As further shown in FIG. 6, the deposition apparatus is arranged such that the deposition sources 680 are provided at the lower half of the coating drum. In other words, the entire arrangement of all deposition sources or at least the arrangement of the middle three deposition sources is provided below the axis 511 of the coating drum 510. Thereby, generated particles, which could contaminate the substrate and the process, remain in the deposition stations due to gravitation. Thus, generation of undesired particles on the substrate can be avoided, and the impact of contaminated particles on the web guide control unit 10 is reduced or even eliminated.

Embodiments described herein refer inter alia to deposition apparatus and methods of operation thereof. The deposition source can be selected from the group consisting of a CVD source, a PECVD source and a PVD source. According to typical implementations, the apparatuses can be used for manufacturing flexible TFT displays, and particularly for barrier layer stacks for flexible TFT displays.

As already described above, the apparatuses and methods according to embodiments described herein can include a plurality of optional features, aspects and details, which might be implemented alternatively or in combination. For example, the methods can include providing an interleaf between layers of substrate on a roll or receiving an interleaf at the unwinding side.

Due to the high temperatures during coating, the web guide control unit according to the present disclosure may be configured to withstand temperatures of at least 50° C., 70° C., or even 100° C. The web temperature or the temperature of the coating drum can be from 20° C. to 250° C. or even up to 400° C. Typically, the substrate thickness can be between 50 μm to 125 μm.

The embodiments of FIGS. 5 and 6 shall particularly illustrate the desire in the technical field of a web guide control unit that allows tension correction in an application where space is a constraint. For instance, technical implementations for web guide control by use of two rollers are not applicable where space constraints allow only for one guide roller. This is particularly true in those fields where the web has to be guided in such a way that one side of the web must not be touched by any of the guide rollers, rolls, coating drums, or the like.

Figure 7:
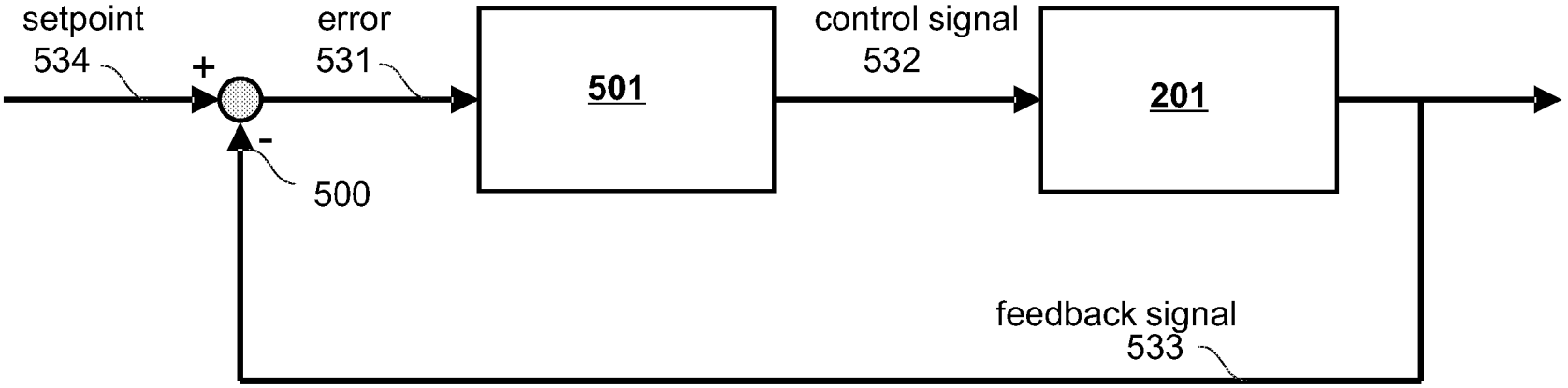
FIG. 7 shows a flow chart of the method for guiding a web according to embodiments of the present subject-matter.

FIG. 7 shows a signal flow chart for the web guide control unit system according to an embodiment of the present subject-matter, which includes a closed-loop controller based on a negative feedback 500 of the transversal tension measurement. The closed-loop system maintains an output of the controlled system, e.g. the feedback signal 533, equal to a setpoint 534 value by using previous values of the feedback signal 533 and a control signal 532 fed to the controlled system which is an output of the controller itself. The main elements of the flow chart are the controller 501 and the guide roller 201 constituting the web guide control unit 10 according to embodiments of the present subject-matter. The tension difference between both sides of the guide roller 201 is the feedback signal 533.

Typically, the setpoint 534 at the controller of the present subject-matter has a null value in order to compensate for tension differences which correspond to transversal tensions acting on the web. Therefore, in typical embodiments of the present subject-matter, the error 531 of the controller 501 exactly corresponds to the tension difference measurement, i.e. the feedback signal 533. In typical embodiments of the present subject-matter the controller compensates deviations from zero of the error 531 using the adjustment unit 310. Typically, this error 531 compensation translates to an adjustment (i.e., movement) of the shaft 215 of the guide roller 201. Therefore, the control signal 532, e.g. the controller output, typically corresponds to the instruction to the adjustment unit of how much the respective end of the guide roller shall be moved.

In principle, different control approaches can be implemented in the controller 501. Typically, a linear control approach is implemented in the controller 501 choosing from: proportional, integral and derivative (PID) control; proportional and integral (PI) control; proportional and derivative (PD) control; and proportional (P) control. However, also other advanced controls using non-linear control approaches may be implemented in embodiments of the present subject-matter, e.g. adaptive gain, dead-time compensation, fuzzy logic, neural networks, or feed-forward control. Controllers implemented in the present application can be analogue or digital interfaces including compatibility with transistor-transistor logic (TTL). Typically, digital interfaces work in a discrete manner where the values for the adjustment unit are refreshed after a certain and fixed time period Δt. Other special features can be present in controllers of the present subject-matter such as self-tuning, signal computation or filtering, or built-in indicators.

As illustration of the functioning of a controller according to an embodiment of the present subject-matter, in the following the implementation of a discrete PID controller is described. The feedback signal at a given control step i corresponds to the difference between both tension measurements Ti301 at the first tension measurement unit 301 and Ti302 at the second tension measurement unit 302. Typically, the setpoint is kept at zero since the controller has to compensate for transversal forces acting on the web, i.e. the tension at both sides of the guide roller 201 should be equal. Therefore, the error signal at a given processing step i corresponds to $$E_i = T_i^{301} - T_i^{302}.$$

The PID controller calculates the output value $D_{i+1}$ by using:

$$D_{i+1} = D_i + K_p E_i + K_d (E_i - E_{i-1}),$$

where the first term corresponds to the integral part of the controller, the second to the proportional, and the third to the derivative. $K_p$ is the proportional band and $K_d$ is the derivative gain. Typically, values of $D_{i+1} - D_i$ other than zero correspond to a variation in the position at one end of the guide roller 201. In other embodiments of the present subject-matter, this corresponds to the signal for operation of the adjustment unit 310 of the guide roller 201, such as the actuator 311, for moving the respective end of the guide roller 201.

This written description uses examples to disclose the subject-matter, including the best mode, and also to enable any person skilled in the art to make and use the subject-matter. While the subject-matter has been described in terms of various specific embodiments, those skilled in the art will recognize that the subject-matter can be practiced with modification within the spirit and scope of the claims. Especially, mutually non-exclusive features of the embodiments described above may be combined with each other. The patentable scope of the subject-matter is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A web guide control unit for guiding a web, the web guide control unit comprising:

a single guide roller, wherein the single guide roller comprises:

an adjustment unit;

two tension measurement units for measuring the tension of the web at a first end and a second end of the single guide roller with the second end being opposite to the first end;

a controller for controlling the adjustment unit; and a data connection for supplying the measured tension from the first end of the single guide roller and the tension measured on the second end of the single guide roller to the controller.

2. The web guide control unit according to claim 1, wherein the two tension measurement units comprise a first tension sensor positioned at the first end of the single guide roller and a second tension sensor positioned at the second end of the single guide roller.

3. The web guide control unit according to claim 1, wherein the adjustment unit comprises an actuator positioned at the first end or the second end of the single guide roller for moving the single guide roller.

4. The web guide control unit according to claim 3, wherein the closed-loop controller comprises one of analogue electronics and digital electronics.

5. The web guide control unit according to claim 1, wherein the controller is a closed-loop controller, and the tension data is used as variable feedback signal.

6. A web processing apparatus comprising:

at least one web guide control unit, wherein each web guide control unit includes only one guide roller, wherein the guide roller comprises:

an adjustment unit;

two tension measurement units for measuring the tension of the web at a first end and a second end of the guide roller with the second end being opposite to the first end;

a controller for controlling the adjustment unit; and a data connection for supplying the measured tension from the first end of the guide roller and the tension measured on the second end of the guide roller to the controller.

7. The web processing apparatus according to claim 6, further comprising a coating unit for coating the web.

8. The web processing apparatus according to claim 6, wherein the two tension measurement units comprise a first tension sensor positioned at the first end of the guide roller and a second tension sensor positioned at the second end of the guide roller.

9. The web processing apparatus according to claim 6, wherein at least two web guide control units are positioned on one side of the coating unit.

10. The web processing apparatus according to claim 6, further comprising a roll for winding or unwinding an interleaf.

11. A method for guiding a web by means of a web guide control unit, the web guide control unit comprising a single guide roller, wherein the single guide roller includes an adjustment unit and two tension measurement units for measuring the tension of the web at a first end and a second end of the single guide roller, a controller for controlling the adjustment unit, and a data connection, the method comprising:

measuring the tension of the web acting on the first end and the second end of the single guide roller, thereby receiving tension data, wherein the second end is opposite to the first end;

adjusting the position of the single guide roller by moving the first end or the second end of the single guide roller; and supplying the measured tension from the first end of the single guide roller and the tension measured on the second end of the single guide roller via the data connection to the controller, wherein the adjusting is based on the measured tension data.

12. The method according to claim 11, wherein the adjusting is undertaken at both the first end and the second end of the single guide roller.

13. The method according to claim 11, further comprising calculating a signal for adjusting the position of the single guide roller based on the measured tension data such that, after adjustment, the tension of the web on both sides is identical.

* * * * *

UNITED STATES PATENT AND TRADEMARK OFFICE

CERTIFICATE OF CORRECTION

PATENT NO. : 9,206,008 B2
APPLICATION NO. : 13/871828
DATED : December 8, 2015
INVENTOR(S) : Hein It is certified that error appears in the above-identified patent and that said Letters Patent is hereby corrected as shown below:

In the specification

Column 3, Line 36, delete "500 m or even less than 10 m" and insert --500 μm or even less than 10 μm-- therefor;

Column 4, Line 19, delete "1 m and 200 m" and insert --1 μm and 200 μm-- therefor.

Signed and Sealed this
Twenty-ninth Day of March, 2016

Michelle K. Lee

Michelle K. Lee
*Director of the United States Patent and Trademark Office*